United States Patent [19]

Bertozzi

[11] Patent Number: 4,658,338

[45] Date of Patent: Apr. 14, 1987

[54] LIGHTING PROJECTORS WITH AN INTENSIFIED AND ACCELERATED AIR FLOW COOLING SYSTEM FOR PHOTOGRAPHIC AND MOTION PICTURE STUDIOS

[75] Inventor: Marcello Bertozzi, Rome, Italy

[73] Assignee: Quartzcolor Ianiro S.p.A., Rome, Italy

[21] Appl. No.: 753,383

[22] Filed: Jul. 2, 1985

[51] Int. Cl.[4] ..... F21V 29/00

[52] U.S. Cl. ..... 362/226; 362/294; 362/373

[58] Field of Search ..... 362/226, 294, 373

[56] References Cited

U.S. PATENT DOCUMENTS 1,611,433 12/1926 Gorretta ..... 362/373
1,758,290 5/1930 McCormack ..... 362/373

FOREIGN PATENT DOCUMENTS 698909 2/1931 France .
799878 6/1936 France ..... 362/373
1114361 4/1956 France ..... 362/226
1201894 8/1970 United Kingdom ..... 362/294

*Primary Examiner*—Craig R. Feinberg
*Attorney, Agent, or Firm*—Mason, Fenwick & Lawrence

[57] ABSTRACT

The object of the invention is a lighting projector with an intensified and accelerated air flow for photographic and motion picture studios, said lighting projector comprising an upper part that houses the bulb as well as a lower part in the form of a case that house the electric assembly for supplying electric power to said bulb, wherein said case has some series of slots in its walls for air inlet, whereas the upper part has a grate cover for venting air; and wherein said case has a Venturi tube diffuser device at a position approximately corresponding to the base of said bulb, said diffuser device consisting of a convergent section and of a divergent section, which are separated by a throat section; and wherein the diffuser has a series of finned slots in its convergent section.

2 Claims, 4 Drawing Figures

LIGHTING PROJECTORS WITH AN INTENSIFIED AND ACCELERATED AIR FLOW COOLING SYSTEM FOR PHOTOGRAPHIC AND MOTION PICTURE STUDIOS

DISCLOSURE OF THE INVENTION

The present invention relates in general to lighting projectors for photographic, motion picture, and television studios, or for theatres and the like, and more particularly the present invention relates to a lighting projector comprising an improved cooling system for the bulb.

As is well known, lighting projectors are commonly used in said studios with bulbs whose powers can be up to 10 kW. Such high values of power give obviously rise to a considerable heating of said bulbs so that their useful life would be too short and consequently they would cause unacceptably high costs if they were not cooled enough. Moreover, such heating also affects the whole apparatus, so that the possibility arises of drawbacks and then the need for an efficient cooling system.

Cooling systems for the bulbs are already known and employed in many lighting apparatuses and the most efficient of the same are based on forced circulation of air. The forced circulation systems, i.e. the systems based on the employment of fans and possibly with outside ducting of hot air, cannot be employed in lighting projectors for photographic or motion picture studios not only because of the high mobility of said apparatuses, but also and mainly because such apparatuses cannot be supplied with fans, as is well known by those who are skilled in the art.

Thus, taking into consideration the fact that the bulbs as well as the whole inside of such apparatuses must be cooled by means of a natural circulation air flow, i.e., a flow of air based on the stack effect, a number of artifices have been invented and set up in the attempt at increasing the efficiency of cooling. In principle, said attempts can be based on the increase of the amount of circulating air or they can be based on the increase of the air velocity. As the sizes of the air inlet slots cannot be increased above a given limiting value because of evident reasons of structure and light tightness, an increase in the circulation air flowrate can be obtained through a suitable design of the sizes and the positions of the inlet air slots together with an increase in the air circulation velocity.

Thus, the main object of the present invention is that of realizing a lighting projector structure that comprises, in addition to the air inlet and outlet slots for the natural circulation of air, also a device that is suitable to increase both the suction effect of the outside air and the velocity of the air flow lapping the bulb.

Stated otherwise, the present invention aims at realizing a device suitable to given an accelerated flow of air, comparable to a forced flow of air, with no population active electromechanical means such as fans and the like, said forced flow of air being specifically conveyed onto the bulb.

According to the practical embodiment of the present invention, the device for intensifying the flow of air is made up of a superficial structure that is so shaped as to form a channel for the passage of the air flow, said channel having a first convergent shape section or compression section, and a second divergent shape section or expansion section, said two sections being separated by a throat section. Such devices are generally known as Venturi tubes.

According to the embodiment, for example, relating to fixed-bulb lighting projectors, the superficial structure is toric, that is, said structure is a proper segment of a Venturi tube, whereas according to a different embodiment, for example an embodiment relating to translatable-bulb or shiftable-bulb lighting projectors (for instance for focussing purposes), such Venturi-effect structure is made up of two shaped surfaces which are opposite, facing and symmetrical.

Further details and advantages of the present invention will be evident from the following disclosure with reference to the enclosed drawings in which the preferred embodiments are shown for illustrative and not for limitative purposes.

Figure 1:
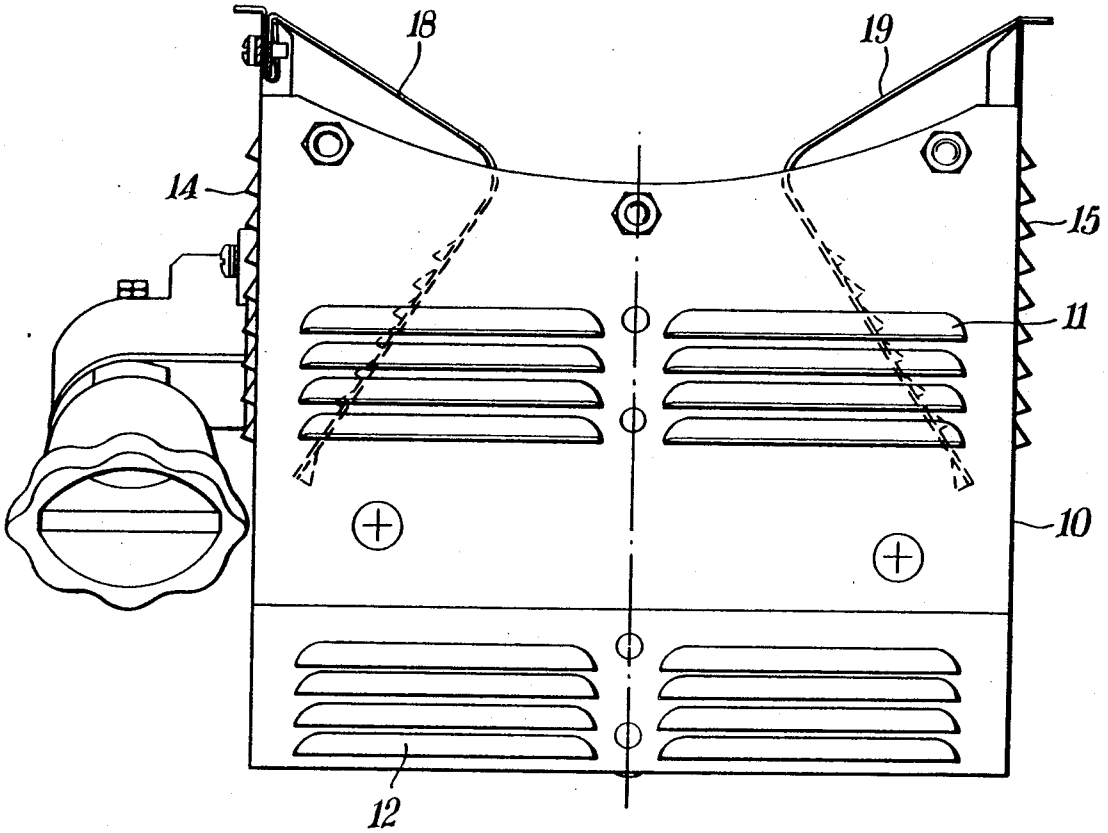
FIG. 1 shows a front view of the lower part or case of a lighting projector according to the present invention.
Figure 2:
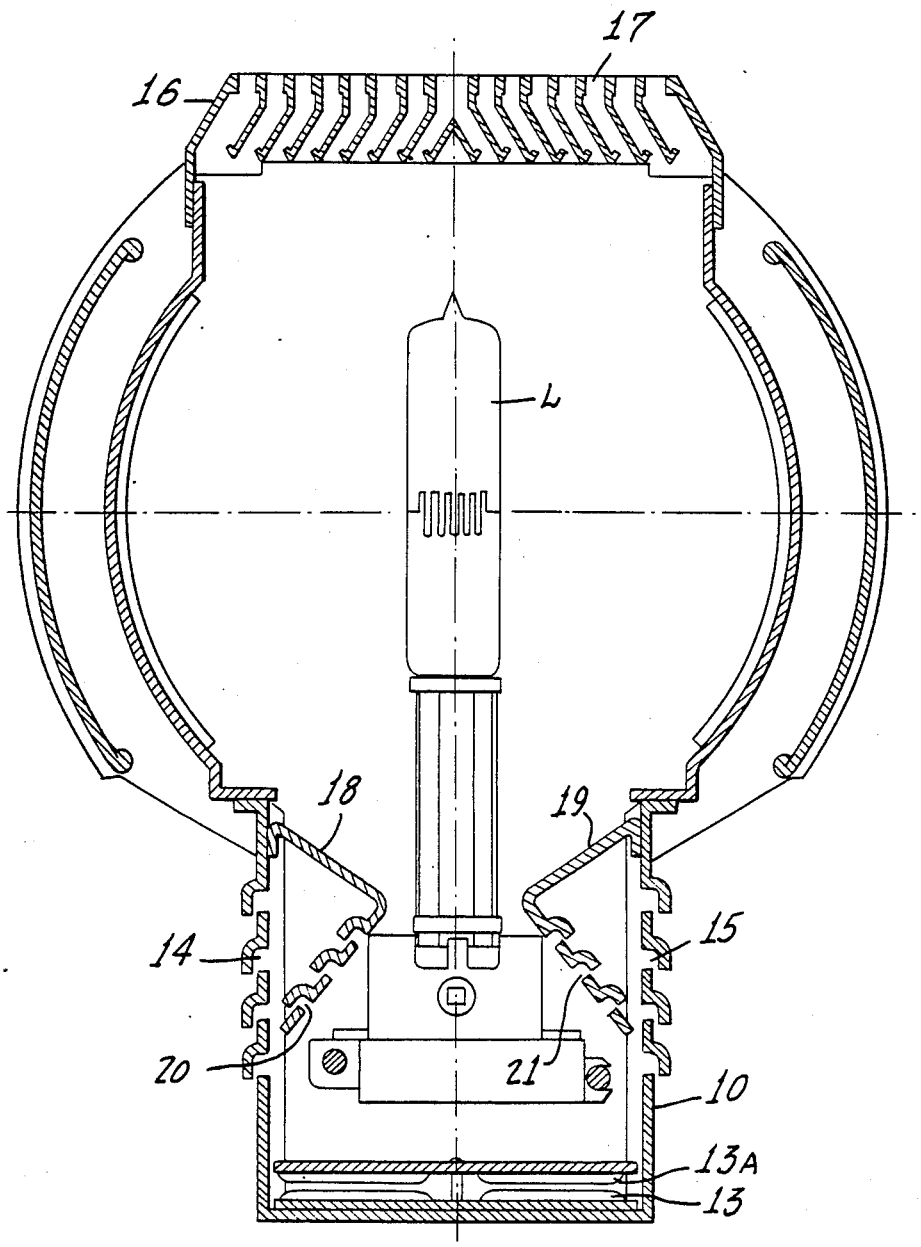
FIG. 2 shows a cross sectional front view of a complete lighting projector according to the present invention.
Figure 3:
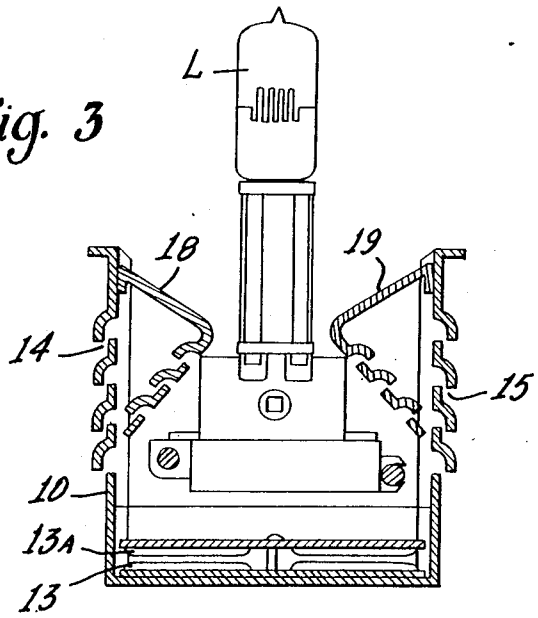
FIG. 3 shows a cross sectional fornt view of the case according to FIG. 1.

With reference now to said drawings and in particular to FIGS. 1 and 2 it can be seen that the lighting projector of the present invention comprises an upper part in which both the bulb L and all relative accessories (not shown) are housed and a lower part in the form of a case 10 housing the whole electric assembly for supplying power to the bulb. It is a main feature of said case 10 that of showing a number of openings or slots arranged in series, and more particularly a series of openings or slots 11 in the front wall, a series of openings or slots 13 in the lower wall and two series of openings or slots 14 and 15 respectively, in the side walls. Such openings, realized as is known in the form of finned louvers, are designed for letting air into the case 10, whereas the air is vented through the cover 16 of the lighting projector which has a grate 17 bearing a series of openings or slots to that aim. All openings, both the air inlet and outlet ones, are realized so that no actinic or ultraviolet radiation losses are allowed to the outside, and so that no vortices are allowed to form that could slow the air flow down; to that aim; the inside counter-openings 11A, 12A and 13A are realized, arranged at a position corresponding to the outside openings 11, 12 and 13, which are contrarily finned, as well as the channel-shaped openings of the gate 17 which are oriented along the lines of flow of air.

The series of side openings 14 and 15 do not show any counter-openings because said case has a device for intensifying and accelerating the air flow, or Venturi-effect diffuser device, which is placed in correspondence to said series of side openings and, as a result of its position and structure, prevents radiation to pass and affects the air flow actively. Said device is arranged approximatively at a position corresponding to the base of the bulb.

Said diffuser device consists of two surfaces or fairings 18 and 19 that are faced and opposed and form a duct for the passage of air, said duct showing, from the bottom to the upper part, a first convergent-shape section and a second divergent-shape section, said two sections being separated by a throat section. Such a structure is closely similar to the structure that is well known to those skilled in the art as the Venturi tube, and said structure behaves like a Venturi. Thus, again from the bottom to the upper part, an increase will occur of the air flow lines density up to a point of maximum density corresponding to the throat section and subsequently a decrease in the density of the air flow lines with a resulting effect of air flow acceleration.

The effect of flow intensification, i.e. the increase as a practical fact in the rate of flow of air, is obtained by providing two series of openings 20 and 21 respectively in the surfaces that form the convergent section, the fairing fins being arranged towards the outside part of the diffuser. Though the presence of such openings does not affect the behavior of the diffuser in itself, it has been observed that their presence permits the obtainment of an increased efficiency with respect to the efficiency that can be expected of the simple diffuser. However, it is to be stressed that two such effects are to be considered independent of each other as well as independently exploitable.

A very remarkable increase is obtained in the cooling of the bulb as a result of the acceleration and intensification of the air flow as well as of the conveying and the directing operation of said air flow towards the bulb arranged on the axis of the Venturi tube structure 18, 19.

A number of experimental tests carried out on such structure showed an increase in the velocity of the air flow (measured with an anemometer at the upper outlet grate 17) by 9 m/minute also and a cooling effect up to 150° C. in comparison with the traditional systems. Obviously, such values are given herein for illustrative purposes only.

Figure 4:
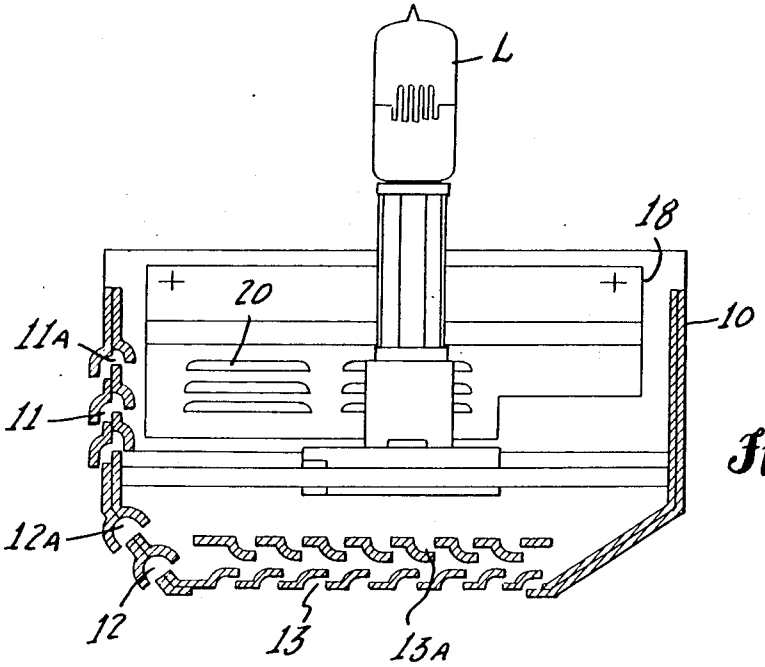
FIG. 4 shows a cross sectional front view of a shiftable-bulb case.

As already pointed out above, when the lighting projector is of the shiftable-bulb type (as illustrated in FIG. 4), the surfaces 18 and 19 of the diffuser are linear surfaces whose symmetry plane contains also the axis of the bulb itself, whereas in the case of a fixed-bulb lighting projector, the surfaces 18 and 19 are in practice one only toroidal surface, the bulb L being arranged on the axis of the tore.

The preferred embodiments of the present invention have been disclosed above, but it is to be understood that those who are skilled in the art can introduce modifications and changes without departing from the scope and spirit of the invention for which a priority right is claimed.

I claim:

1. A lighting projector for photographic and motion picture studios, comprising a bulb, an upper housing portion including said bulb, a lower housing portion concentric with said upper housing portion including means for holding said bulb and electrical power supply accessories for said bulb and having walls provided with a series of air inlet openings, an air outlet grate cover forming a top wall of said upper housing portion, a Venturi tube diffuser device arranged within said lower housing portion and consisting of a truncated toroidal cone convergent in a direction towards said upper housing portion having one end starting from a side wall of said lower housing portion and extending at a predetermined angle upwardly and inwardly toward a central axis of said upper housing portion and ending at a selected distance from said axis along a plane normal to said axis and a truncated toroidal cone divergent in a direction towards said upper housing portion starting from said plane and upwardly extending outward to an upper edge of said lower housing portion side wall so as to form a central throat, whereby an increase of the air flow within said central throat is obtained, said convergent truncated cone having a series of openings in correspondence to said series of air inlet openings, said both series of openings being shaped in form of finned louvers, a further series of finned louvers being provided in the lower edge of said lower housing portion, and said divergent truncated cone being imperferate.

2. A lighting projector as claimed in claim 1, wherein said grate cover consists of a plurality of parallel concentrical fins having a lower portion inclined toward the central axis of said upper housing and an upper portion parallel to said central axis, whereby an increase of the outlet air flow is obtained.

* * * * *